United States Patent [19]

van der Wal

[11] Patent Number: 4,886,217

[45] Date of Patent: Dec. 12, 1989

[54] JAW CRUSHER

[76] Inventor: Anne van der Wal, No. 7, Harddraversweg, NL-8501 CG Joure, Netherlands

[21] Appl. No.: 205,865

[22] Filed: Jun. 13, 1988

[30] Foreign Application Priority Data

Jun. 23, 1987 [NL] Netherlands ..... 8701465

[51] Int. Cl.[4] ..... B02C 1/02

[52] U.S. Cl. ..... 241/219; 241/269

[58] Field of Search ..... 241/264–269, 241/101.2, 219

[56] References Cited

U.S. PATENT DOCUMENTS 860,783 7/1907 Bell ..... 241/219

4,406,412 9/1983 Alexandersson ..... 241/266 X

FOREIGN PATENT DOCUMENTS 915529 1/1963 United Kingdom .

*Primary Examiner*—Mark Rosenbaum

*Attorney, Agent, or Firm*—Watson, Cole, Grindle & Watson

[57] ABSTRACT

A device for breaking stony material includes a frame, first and second substantially vertical crushing jaws with pressure surfaces connected to the frame so as to face each other and define an inlet opening for material to be broken close to their top ends and a discharge opening for broken material close to their bottom ends, a toggle lever system and pulling rod to which at least one crushing jaw is mounted for movement, and a hydraulic piston-cylinder for moving the toggle lever system and pulling rod so as to cause at least one of the crushing jaws to move in a first direction towards the other jaw and in a second direction transverse to the first.

13 Claims, 3 Drawing Sheets

JAW CRUSHER

BACKGROUND OF THE INVENTION

1. Field of the Invention

The invention relates to a device for breaking stony material comprising a frame, first and second substantially vertical crushing jaws connected to the frame and comprising pressure surfaces facing each other, which jaws define between them an inlet opening close to their top end for material to be broken and a discharge opening close to their bottom end for broken material, guiding means to which at least one crushing jaw is mounted for movement, and drive means for moving the crushing jaws relative to each other in a direction towards each other.

2. The Prior Art

Such a device, described as a jaw crusher, is known from British patent specification No. 915.529. Using such a device rubble for example can be made smaller for further processing. Such a device is also employed in stone quarries for breaking large lumps of stone into broken stones. In devices of the known type the stony material for breaking is subjected to a pressure load between the crushing jaws that exceeds the compression strength of the material so that the material disintegrates. The forces occurring here are very great, and when the stone material disintegrates, shock loads affect the device.

The object of the invention is the provision of a device of the above-stated type which works more evenly and is exposed to fewer unfavorable loadings.

SUMMARY OF THE INVENTION

This aim is achieved in a device of the current type of the invention in that the guiding means also impose on the crushing jaws during their movement towards each other a relative movement transversely of the pressure surfaces. As a result the stone material to be broken in the jaw crusher is exposed not only to a pressure load but simultaneously also to a shear load. The resulting stresses caused in the stone material have the consequence that it disintegrates at a lower pressure and more uniformly.

The relative movement transversely of the pressure surfaces applied in accordance with the invention can occur in any desired direction but is preferably obtained by one crushing jaw being mounted rigidly on the frame and the other crushing jaw being mounted close to its top end for pivoting and downward movement. The simultaneous downward and pivoting movements can be structurally realized in a fairly simple manner.

A preferred construction of the device according to invention is obtained when the guiding means comprise an toggle lever system between the frame and the lower part of a movable crushing jaw, a pivot-slide guiding close to the top end of the crushing jaw and a pulling arm connected for pivoting with the upper part of the crushing jaw and with the arm of the toggle lever system connected to the frame. The pulling arm effects the vertical movement of the movable crushing jaw in a very suitable manner.

If, in accordance with a very favorable further development of the invention, the point of engagement of the pulling arm on the arm of the toggle lever system is adjustable in lengthwise direction of this arm, the relation between the movement of the crushing jaws towards each other and the relative transverse movement can be altered.

In the case of comparatively soft stone material, such as brick for example, a large transverse movement may be favorable. In the case of very hard material a very limited transverse movement may be enough to bring about the required effect.

In a further embodiment the pulling arm is connected by a slide guiding to the arm of the toggle lever system and that a hydraulic adjusting piston cylinder is arranged connected with one end to the pulling arm and with the other end to the toggle lever arm. The desired relation mentioned above can as a result be set during operation. The adjusting piston cylinder can also be manipulated for optimum action of the device during breaking.

The drive means are preferably hydraulic drive means. Overloading of the device as can occur in other known jaw crushers driven with a flywheel is hereby prevented.

Efficient use of the device according to the invention is achieved when a movable breaking jaw comprises a number of separately controllable sections placed adjacent to one another. Only those sections are actuated against which material for breaking is situated.

In the case a hydraulic driving is used, use is preferably made of a per se known hydraulic pump which at low pressure supplies a volume and which in the case of increasing counter pressure will automatically supply less volume at higher pressure. The jaw crusher according to the invention operates quickly and efficiently as a result.

The invention will be further elucidated in the following description of a number of preferred embodiments, with reference to the annexed drawings.

DETAILED DESCRIPTION OF THE PREFERRED EMBODIMENTS

Figure 1:
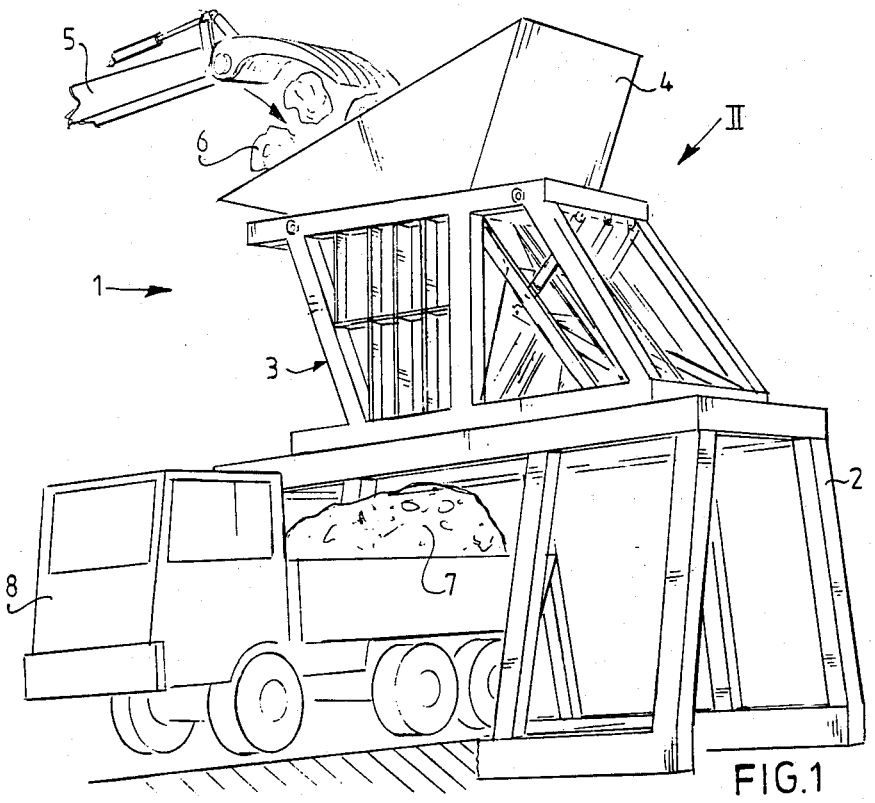
FIG. 1 shows a simplified perspective view of a device according to the invention in the operating position.

The device according to the invention shown in FIG. 1 for the breaking of stony material comprises the actual jaw crusher 3 which is placed on an underframe 2 and on which is arranged a feed chute 4.

Stony material 6 to be crushed is tipped into feed chute 4, for example using an excavator 5. The broken material 7 is released on the underside of jaw crusher 3 and can be carried away using for instance a goods vehicle 8. Instead of a goods vehicle 8 a belt conveyor may also be used for transporting the broken material 7 to a storage site.

Figure 2:
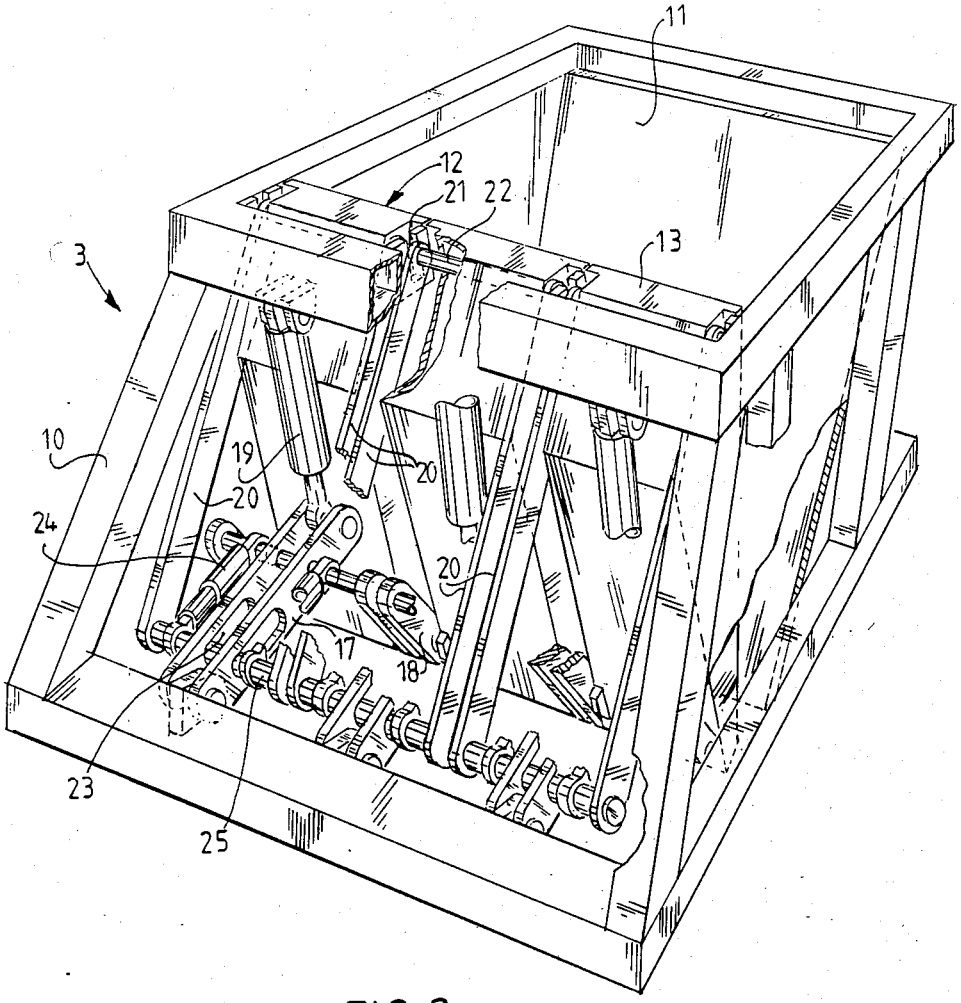
FIG. 2 shows a partly broken away, slightly schematic perspective view along arrow II in FIG. 1 of the actual crushing part of the device.

As FIG. 2 shows, the jaw crusher 3 conprises a frame 10. Arranged in frame 10 is a fixed crusing jaw 11 and a movable crushing jaw 12. The latter is built up in the embodiment shown of three sections 13 which can be actuated individually.

Crushing jaws 11 and 12 comprise pressure surfaces facing each other which extend sustantially vertically. The pressure surfaces are provided in the usual manner with profiled, replaceable wear surfaces which ensure a good grip on the stony material 6 for breaking.

Close to their top end the crushing jaws 11, 12 define an intake opening 14 and close to their bottom end a discharge opening 15. As is shown in FIG. 1 the feed chute 4 connects onto the intake opening 14.

Each section 13 of the mobile crushing jaw 12 is mounted in the device by means of guiding means 16. These guiding means 16 enable movement of the movable jaw 12 towards the fixed jaw 11, while the movable jaw 12 can also move downward transversely of the fixed crushing jaw 11.

Guiding means 16 comprise a toggle lever system formed by two arms 17, 18. Gripping onto the produced part of arm 17 is a hydraulic piston cyclinder 19. The movable jaw 12 is mounted at its top end for pivoting and downward displacement in a guide slot 21. As FIG. 2 shows, each section 13 comprises for this purpose a rod 22 which extends transversely through the top end. The ends of this rod 22 fall into the guide slots 21. The top end of a pulling arm 20 is also mounted on this rod 22, this pulling arm being connected for pivoting with its bottom end to the arm 17 of the toggle lever system connected to the frame 10.

When the piston cylinder 19 is set into operation the arm 17 is pivoted downward. Through the toggle lever action the bottom end of the movable crushing jaw 12 is simultaneously forced the the right. Since the pulling arm 20 is in engagement at a distance from the end of the arm 17 connected to frame 10, the pulling arm 20 is also drawn downward. As a result the top end of crushing jaw 12 is forced downward in the slot 21. Crushing jaw 12 thus moves towards crushing jaw 11, but moves at the same time downward in transverse direction thereof.

According to a preferred embodiment of the invention the point of engagement of the pulling arm 20 on the arm 17 of the toggle lever system is adjustable in lengthwise direction of the arm 17.

Figure 3:
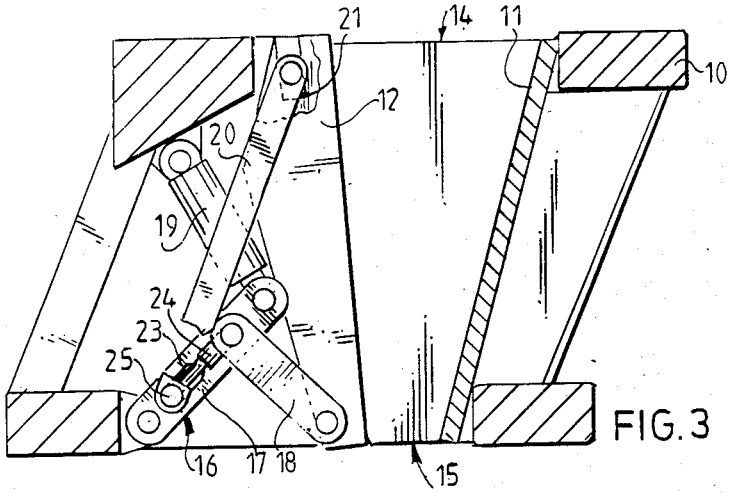
FIG. 3 is a schematic section of the device from FIG. 2.
Figure 4:
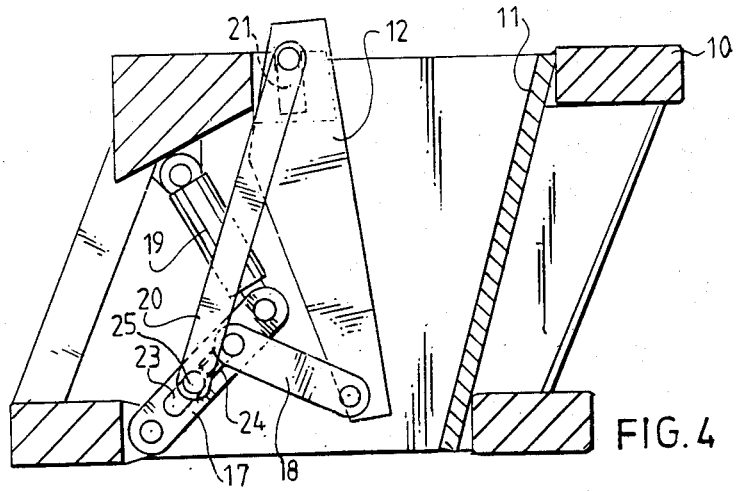
FIGS. 4 and 5 show views corresponding to FIG. 3 of the same device in two operating positions at a different setting.
Figure 5:
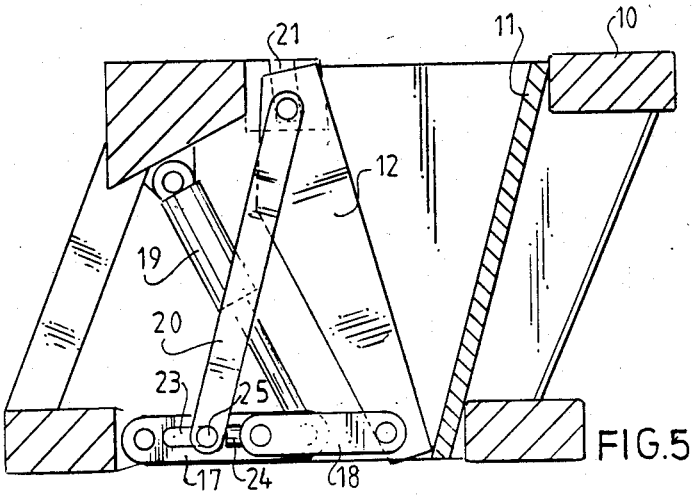

In this regard, as is shown in FIG. 2, each section 13 of the movable crushing jaw 12 has two pulling arms 20 which are connected at their bottom ends by a rod 25. This rod 25 extends through a slot 23 arranged in the paired arm 17. The position of rod 25 in slot 23, and therefore the point of engagement of the pulling arm relative to arm 17, is adjusted with two adjusting piston cylinders 24. The relation of the relative vertical movement with respect to the movement toward each other of the two crushing jaws can be varied by adjustment of the point of engagement. FIG. 3 thus shows in full lines the starting position of the movable jaw 12 at the setting whereby the engagement point of the pulling arm 20 lies closest to the point of rotation of the arm 17 connected to the frame 10. FIG. 4 and 5 show respectively the commencing and end position at a setting whereby the engagement point of the pulling arm 20 is at the maximum distance from the pivot of the arm 17 that is connected to frame 10. As will be seen from a comparison of FIGS. 4 and 5 with FIG. 3, at the setting of FIGS. 4 and 5 the verical movement is considerably greater. At the outermost setting of FIGS. 4 and 5 the movable crushing jaw 12 even moves virtually parallel to itself so that the effect exerted on the material for breaking is mainly a "rubbing" effect.

When the jaw crusher is executed such that the point of engagement of the pulling arm 20 on the arm 17 comes to lie coaxially of the pivoting point of this arm 17, the stone breaker acts entirely as a conventional breaker without the relative transverse movement of the crushing jaws.

Using the piston cylinders 24 the setting may be altered during operation. This enables a direct adaption to material to be broken, for instance when this consists of different sorts.

Figure 6:
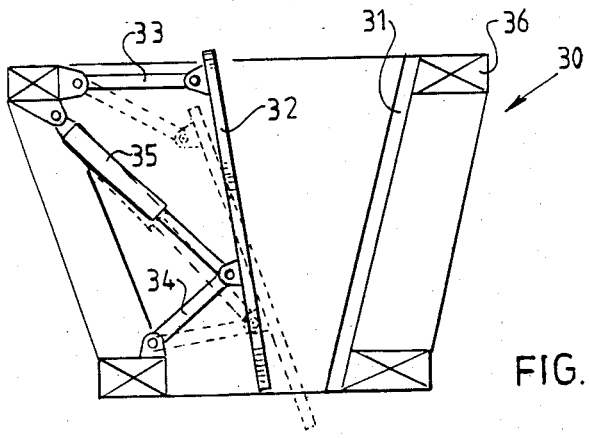
FIG. 6 is a schematic cross section of an alternative embodiment.

The guiding means for the movable crushing jaw or jaws can be embodied in many different ways. FIG. 6 shows an alternative embodiment. The device 30 shown therein comprises a frame 36 in which a fixed crushing jaw 31 and a movable crushing jaws 32 attached close to its top end for pivoting to frame 36 using a rod 33 and close to its bottom end with a rod 34. In this way the movable crushing jaw forms together with the rods 33, 34 and the frame 30 a rod four bar linkage. Through driving of the piston cylinder 35 the movable crushing jaw 32 can be moved from the position drawn in full lines into the position in dashed lines. The movement of crushing jaw 32 is again a combination of a movement directed towards the fixed crushing jaw 31 and one directed transversely thereof, and in particular downward. The four bar linkgage formed by the different elements can be dimensioned in a known manner such that the desired movement of the crushing jaw is obtained.

The embodiments of the device according to the invention shown in the figures and described above are provided in each case with one fixed crushing jaw and one movable crushing jaw having a downwardly directed, transverse movement component. Although this embodiment is to be preferred for structural and operational reasons, the invention can be applied in many other ways. Thus, for example, one crushing jaw may perform a horizontal movement, while the other crushing jaw carries out the transverse movement. Instead of being vertical this transverse movement may thereby also be horizontal. As noted earlier, the crushing jaws are provided with a suitable profiling in order to obtain a good grip on the material to be broken.

I claim:

1. A crusher device comprising in combination, a frame, first and second spaced, generally vertically disposed crusher jaws supported by said frame, said first and second jaws having upper portions with upper ends that define therebetween an inlet for material to be crushed and lower portions with lower ends that define therebetween an outlet for crushed material, said second jaw being supported by the frame for reciprocating movement in a first direction toward and away from said first jaw, drive means for reciprocating said second jaw, and means for causing movement of said second jaw in a second direction transverse to said first direction while moving the lower portion of said second jaw a substantially greater distance in said first direction than the upper portion of said second jaw.

2. A crusher device as defined in claim 1 wherein said first jaw is fixedly secured to the frame and said second jaws is movably supported by said frame for swinging and downward movement relative to said first jaw.

3. A crusher device as defined in claim 2 including a toggle lever system connected between said frame and the lower portion of said second jaw, and a pulling arm pivotally connected between the upper portion of said second jaw and said toggle lever system.

4. A crusher device as defined in claim 3 including adjusting means for adjusting the position of the pivotal connection of said pulling arm relative to said toggle lever system.

5. A crusher device as defined in claim 4 wherein said adjusting means includes a hydraulic cylinder means connected between said pulling arm and said toggle lever system.

6. A crusher device as defined in claim 2 wherein said second jaw comprises a plurality of separate sections movable relative to one another, and means for separately operating said sections.

7. A crusher device as defined in claim 1 wherein said drive means comprises hydraulically operated means.

8. A crusher device comprising in combination, a frame, first and second spaced, generally vertically disposed crusher jaws supported by said frame, said jaws defining a channel therebetween having a top inlet opening for receiving material to be crushed and a lower outlet opening for crushed material, said first jaw being fixedly secured to the frame, said second jaw being movably supported by said frame and having an upper portion thereof supported by pivot means for pivotal movement about a pivot axis, guide means supported by said frame for guiding said pivot means for reciprocating movement in a generally vertical direction relative to said frame, link means supported by said frame and being connected to a lower portion of said second jaw, and drive means connected with said link means for moving said second jaw toward said first jaw and downwardly with respect thereto.

9. A crusher device as defined in claim 8 wherein said second jaw comprises a plurality of separate sections movable relative to one another, and means for separately operating said sections.

10. A crusher device as defined in claim 8 wherein said link means comprises a pair of links pivotally connected to one another, one of said links being pivotally connected to said frame, the other of said links being pivotally connected to a lower portion of said second jaw, drive means operatively connected with one of said pair of links, and an arm having the lower end thereof pivotally connected to one of said links, the upper end thereof being mounted for pivotal movement about said axis.

11. A crusher device as defined in claim 10 including adjusting means for adjusting the position of the pivotal interconnection of said arm to the associated link.

12. A crusher device as defined in claim 11 wherein said adjusting means comprises a hydraulic cylinder means connected between said arm and said link.

13. A crusher device comprising in combination, a frame, first and second spaced crusher jaws supported by the frame, said jaws having first portions with first ends defining therebetween an inlet for material to be crushed and second portions with second ends defining therebetween an outlet for crushed material, one of said jaws being supported by the frame for reciprocating movement in a first direction toward and away from the other of said jaws, first link means pivotally connected between said first portion of said one jaw and said frame, second link means pivotally connected between said lower portion of said one jaw and said frame, and drive means pivotally connected between said frame and said lower portion of said one jaw for reciprocating said one jaw in a first direction toward and away from other of said jaws and for causing movement of said one jaw in a second direction transverse to said first direction while moving said lower portion of said one jaw a substantially greater distance in said first direction than said upper portion of said one jaw.

* * * * *